US007575230B2

(12) United States Patent
Kamiya et al.

(10) Patent No.: US 7,575,230 B2
(45) Date of Patent: Aug. 18, 2009

(54) SHEET PROCESS APPARATUS

(75) Inventors: Daisaku Kamiya, Abiko (JP); Hideki Kushida, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 355 days.

(21) Appl. No.: 11/509,742

(22) Filed: Aug. 25, 2006

(65) Prior Publication Data

US 2007/0057427 A1 Mar. 15, 2007

(30) Foreign Application Priority Data

Sep. 13, 2005 (JP) ..... 2005-264779

(51) Int. Cl.
*B65H 37/04* (2006.01)

(52) U.S. Cl. ..... 270/58.12; 270/58.07; 270/58.1; 270/58.17; 270/58.27

(58) Field of Classification Search ..... 270/58.07, 270/58.1, 58.12, 58.17, 58.27
See application file for complete search history.

(56) References Cited

U.S. PATENT DOCUMENTS

| | | | | |
|---|---|---|---|---|
| 6,273,418 | B1 * | 8/2001 | Fujikura et al. | 271/228 |
| 6,290,220 | B1 * | 9/2001 | Takehara et al. | 270/58.12 |
| 6,783,124 | B2 * | 8/2004 | Tamura et al. | 270/58.07 |
| 6,796,456 | B2 | 9/2004 | Nakaoda | |
| 6,873,812 | B2 * | 3/2005 | Kobayashi | 399/193 |
| 6,905,118 | B2 * | 6/2005 | Yamada et al. | 270/8 |
| 7,021,616 | B2 | 4/2006 | Mizuta et al. | 270/58.11 |
| 7,389,980 | B2 * | 6/2008 | Kushida | 270/58.12 |
| 7,401,776 | B2 * | 7/2008 | Obuchi et al. | 271/228 |
| 7,445,207 | B2 * | 11/2008 | Obuchi et al. | 271/228 |
| 7,490,822 | B2 * | 2/2009 | Kushida | 270/58.12 |
| 2006/0055100 | A1 * | 3/2006 | Suzuki et al. | 270/45 |
| 2006/0125171 | A1 | 6/2006 | Mizuta et al. | 270/58.11 |
| 2007/0057425 | A1 * | 3/2007 | Kamiya | 270/52.18 |

FOREIGN PATENT DOCUMENTS

| | | |
|---|---|---|
| JP | 2-45563 B2 | 10/1990 |
| JP | 9-71357 | 3/1997 |
| JP | 10-181988 | 7/1998 |
| JP | 2003-327347 A | 11/2003 |

OTHER PUBLICATIONS

Japanese Office Action dated Nov. 11, 2008 in Japanese Application No. 2005-264779, and an English-language translation thereof.

* cited by examiner

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

Provided is a shift transport device for transporting a sheet to a sheet transport direction upstream side of a sheet process tray and for shifting the sheet. The shift transport device offsets the sheet and the sheets are stacked on a sheet process tray. Then, the sheets stacked on the sheet process tray in a state of being offset are aligned by an aligning member.

4 Claims, 16 Drawing Sheets

P1
P2
P3
SHEET TRANSPORT DIRECTION
ALIGNING DIRECTION
1
2
3
4
L

P1
SHEET TRANSPORT DIRECTION
2
ALIGNING DIRECTION

P1
P2
SHEET TRANSPORT DIRECTION
1
2
3
4
L2
ALIGNING DIRECTION 1
2
3
4

P
SHEET TRANSPORT DIRECTION
2
3
4
ALIGNING DIRECTION

P
1
2
3
4

P
1
2
3
4

SHEET PROCESS APPARATUS

BACKGROUND OF THE INVENTION

1. Field of the Invention

The present invention relates to a sheet process apparatus for aligning sheets stacked on a sheet process tray.

2. Related Background Art

Up to now, in some image forming apparatuses such as a copying machine, a printer, a facsimile, and a multifunctional apparatus, a sheet process apparatus for performing a process such as a binding process with respect to sheets delivered from an image forming apparatus main body is provided in the image forming apparatus main body.

Some sheet process apparatuses stack delivered sheets on a process tray, align them, and then, perform a process such as a binding process with respect to the sheets (i.e., a sheet stack or sheet bundle). Further, some sheet process apparatuses wind a plurality of sheets around a buffer roller once, without directly feeding the delivered sheets to the process tray, so the sheets can be transported to the process tray together with a subsequent sheet.

Some sheet process apparatuses with such a configuration, for example, have a path 1160 for winding around a buffer roller 1151 capable of overlapping a plurality of sheets, as shown in FIG. 17. Sheets are wound around the buffer roller 1151 under the condition that a previous stack PA is processed in a process tray 1138.

Then, a plurality of sheets are wound around the buffer roller 1151, whereby a process time in a process tray 1138 with respect to the sheets delivered at a high speed and at a small sheet interval from the image forming apparatus main body can be ensured (see JP-A-H10-181988).

A plurality of sheets wound around the buffer roller 1151 as described above are transported to the process tray 1138 under the condition in which those sheets are overlapped. Then, the sheets are sandwiched between discharge rollers 1128 and stack discharge rollers 1130*a*, 1130*b*, and transported until sheet trailing ends come out of the discharge rollers 1128. Further, after this, the sheet bundle PA is returned to a trailing end regulating member side (not shown) of the process tray 1138 by the reverse rotation of the stack discharge rollers 1130*a*, 1130*b* shown in FIG. 18.

Herein, by separating the stack discharge roller 1130*b* from the stack discharge roller 1130*a* before the trailing end of the sheet bundle PA comes into contact with the trailing end regulating member, and pressing the trailing end of the sheet bundle PA against the trailing end regulating member by return means such as a paddle (not shown), the trailing end regulation of the sheet bundle PA is performed. After such trailing end regulation, the sheet bundle PA is aligned in a direction (hereinafter, referred to as a lateral direction) orthogonal to a sheet transport direction of the sheet bundle PA by an aligning plate (not shown).

In such a conventional sheet process apparatus, for example, when three overlapped sheets are transported to the process tray 1138, a middle sheet P2 may be displaced in the lateral direction for some reason, for example, as shown in FIGS. 19A and 19B. To be more specific, the middle sheet P2 may protrude in the lateral direction, compared with the upper and lower sheets P1 and P3.

In this case, when an aligning plate 1 is moved toward an aligning plate 2 so as to align the sheet bundle PA in the lateral direction, the aligning plate 1 presses a side end of the sheet bundle PA. At this time, in particular, when the aligning plate 1 presses an upstream side in the transport direction of the sheet bundle PA, the middle sheet P2 may be in a tilted state when the aligning plate 1 reaches a predetermined alignment completion position.

Herein, the trailing end regulation of the sheet bundle PA is performed again after such alignment in the lateral direction is performed. In such a state, the upper and lower sheets P1 and P3 generate resistance, with the result that the middle sheet P2 cannot move to the trailing end regulating member side even if the self weight or the return means is acted. Consequently, alignment displacement is caused as shown in FIG. 19C.

That is, in the case where the middle sheet P2 protrudes in the lateral direction, compared with the upper and lower sheets P1 and P3, the upper sheet P3 returns first, which generates resistance, with the result that the middle sheet P2 cannot return to cause an alignment defect. This phenomenon is conspicuous particularly in the case where a sheet P has a large size such as an A3size, because the pressing position of the aligning plate 1 falls on a trailing end side with respect to the center of gravity of the sheet P.

In the case of placing sheets on the process tray 1138 one by one, the sheet P1 can be returned to the direction of the trailing end regulating members 3 and 4 by the self weight or the return means, even if the sheet P1 tilts after the alignment as shown in FIGS. 20A, 20B and 20C.

In order to overcome the above problem, it is possible that the aligning plate 1 is set to be longer (or larger) in the sheet transport direction. However, for example, in an apparatus in which sheets are stacked across the process tray 1138 and a stack tray 1137 shown in FIG. 17 so that the apparatus is miniaturized, the process tray 1138 is made to be long, which enlarges the apparatus. Further, it is also possible that aligning means replacing the aligning plate is placed separately on the stack tray 1137. In this case, however, the apparatus is made to be complicated.

SUMMARY OF THE INVENTION

The present invention has been achieved in view of the above-mentioned situation, and its object is to provide a sheet process apparatus and an image forming apparatus capable of enhancing the alignment of sheets.

According to one aspect of the present invention, a sheet process apparatus for aligning sheets stacked on a sheet process tray includes: an aligning member which aligns the sheets stacked on the sheet process tray; a shift transport device provided on an upstream side in a sheet transport direction of the sheet process tray, which transports the sheets while shifting the sheets in an alignment direction of the aligning member and shifts each sheet to be transported in the same direction as that of a preceding sheet successively, and in the sheet process apparatus, a plurality of sheets transported by the shift transport device are stacked on the sheet process tray, and the plurality of sheets received on the sheet process tray are aligned by the aligning member.

According to another aspect of the present invention, a sheets process apparatus includes: a shift transport device which transports sheets, and shifts a sheet with respect to a preceding sheet in a lateral direction crossing a direction in which the sheets are transported; a sheet process tray on which a plurality of sheets transported by the shift transport device are stacked in a state of being offset in the lateral direction when the shift transport device shifts the sheets; and a pair of aligning members which align, in the lateral direction, the plurality of sheets offset and stacked on the sheet process tray.

The sheets are offset and placed on the sheet process tray. The sheets on the sheet process tray are aligned by the aligning member. Thus, the alignment of the sheets can be enhanced.

Further features of the present invention will become apparent from the following description of exemplary embodiments with reference to the attached drawings.

DESCRIPTION OF THE EMBODIMENTS

Hereinafter, the best embodiments for carrying out the present invention will be described with reference to the drawings.

Figure 1:
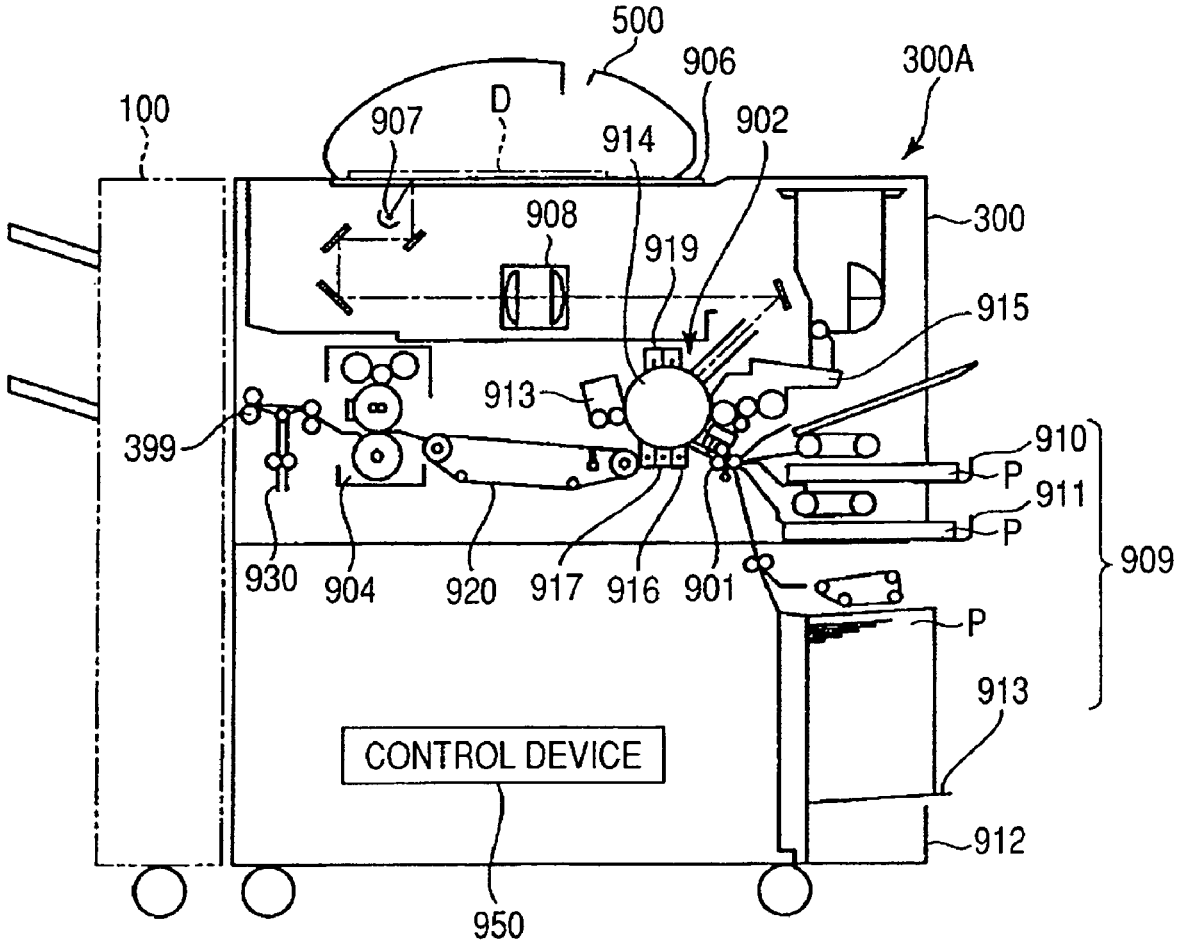
FIG. 1 is a view showing a configuration of a copying machine that is an example of an image forming apparatus having a sheet process apparatus according to first Embodiment of the present invention.

FIG. 1 is a view showing a configuration of a copying machine that is an exemplary image forming apparatus having a sheet process apparatus according to first Embodiment of the present invention. In FIG. 1, reference numeral 300A denotes a copying machine, and 300 denotes a copying machine body. In the copying machine body (hereinafter, referred to as an "apparatus body") 300, a platen glass 906 serving as an original stack table, a light source 907, and a lens system 908 are provided.

Further, the apparatus body 300 includes a sheet feeding portion 909, an image forming portion 902, an automatic document feeder 500 for feeding an original D to the platen glass 906, a sheet process apparatus 100 for processing a sheet with an image formed thereon delivered from the copying machine body 300, and the like.

Herein, the sheet feeding portion 909 has cassettes 910 and 911 which accommodate sheets P for recording and are attachable/detachable to the apparatus body 300, and a deck 913 placed on a pedestal 912. The image forming portion 902 includes a cylindrical photosensitive drum 914, and a developing unit 915, a charger 196 for transfer, a stripping charger 917, a cleaner 918, and a primary charger 919, which are placed around the photosensitive drum 914, and the like.

On a downstream side of the image forming portion 902, a transport device 920, a fixing device 904, a pair of discharge rollers 399, and the like are provided. Reference numeral 950 denotes a control device for controlling the entire image forming operation of the apparatus body 300.

Next, the operation of the copying machine 300A with such the configuration will be described.

When a feed signal is output from the control device 950 provided in the apparatus body 300, the original D stacked on the original stack table 906 is irradiated with light from the light source 907, and the light reflected from the original D is radiated to the photosensitive drum 914 through the lens system 908. Herein, the photosensitive drum 914 is previously charged by the primary charger 919, and irradiated with light, whereby an electrostatic latent image is formed. Then, the electrostatic latent image is developed by the developing unit 915, whereby a toner image is formed on the photosensitive drum 914.

On the other hand, in the sheet feeding portion 909, the sheet P is fed from the cassettes 910 and 911 or the deck 913, and the sheet P has the skew corrected by a registration roller 901. Further, the sheet P is sent to the image forming portion 902 with a timing adjusted.

Then, in the image forming portion 902, the toner image of the photosensitive drum 914 is transferred to the sent sheet P by the charger for transfer 916. After that, the sheet P with a toner image transferred thereon is charged to a polarity opposite to that of the charger for transfer 916 by the stripping charger 917, and separated from the photosensitive drum 914.

The separated sheet P is transported to the fixing device 904 by the transport device 920, and a transfer image is permanently fixed to the sheet P by the fixing device 904. Further, the sheet P with an image fixed thereon is delivered from the apparatus body 300 by the pair of discharge rollers 399 in a straight delivery mode in which an image surface is placed upward or in an inversion delivery mode in which the sheet P is transported to a sheet inversion path 930 after the fixing of an image, and the sheet P is inverted so as to place the image surface downward. Thus, the sheet P fed from the sheet feeding portion 909 is delivered to the sheet process apparatus 100 with an image formed thereon.

Figure 2:
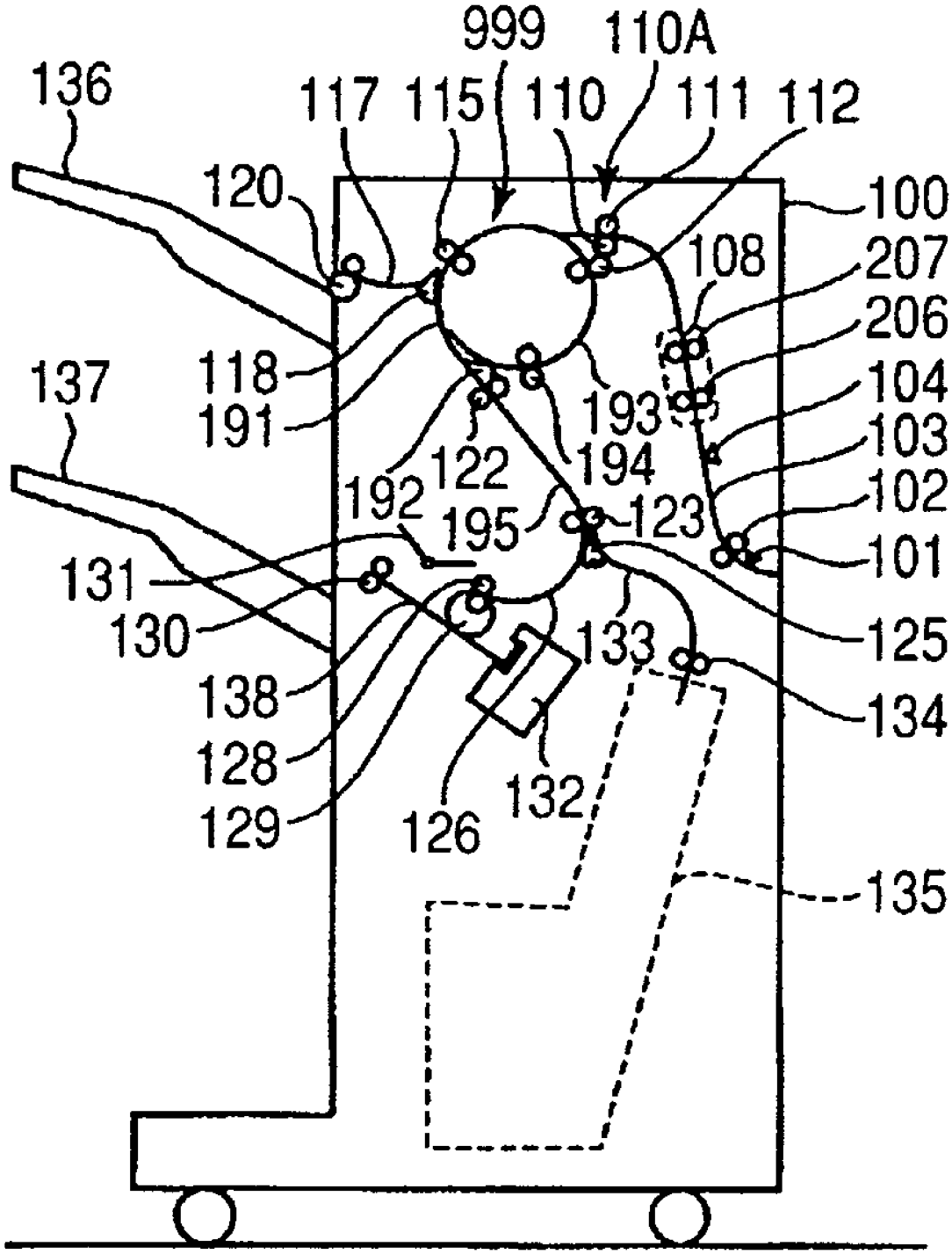
FIG. 2 is a view showing a configuration of the sheet process apparatus.

FIG. 2 shows a configuration of the sheet process apparatus 100. As shown in FIG. 2, the sheet process apparatus 100 includes a lateral registration sensor 104 for detecting the end position of a sheet, pairs of shift rollers 206 and 207, and a shift unit 108 serving as a shift transport device capable of moving in the lateral direction.

Further, the sheet process apparatus 100 includes a buffering portion 999 having a plurality of pairs of buffer rollers 115, 194, and 112 capable of holding a plurality of sheets and a buffer path 193, a saddle unit 135 for performing a saddle stitching process, a stapler 132 for stitching a sheet bundle, and the like.

In the sheet process apparatus 100 with such the configuration, when a sheet is delivered from the apparatus body 300, the sheet is first delivered to a pair of inlet rollers 102 shown in FIG. 2. At this time, the sheet delivery timing is detected simultaneously by an inlet sensor 101.

Figure 6:
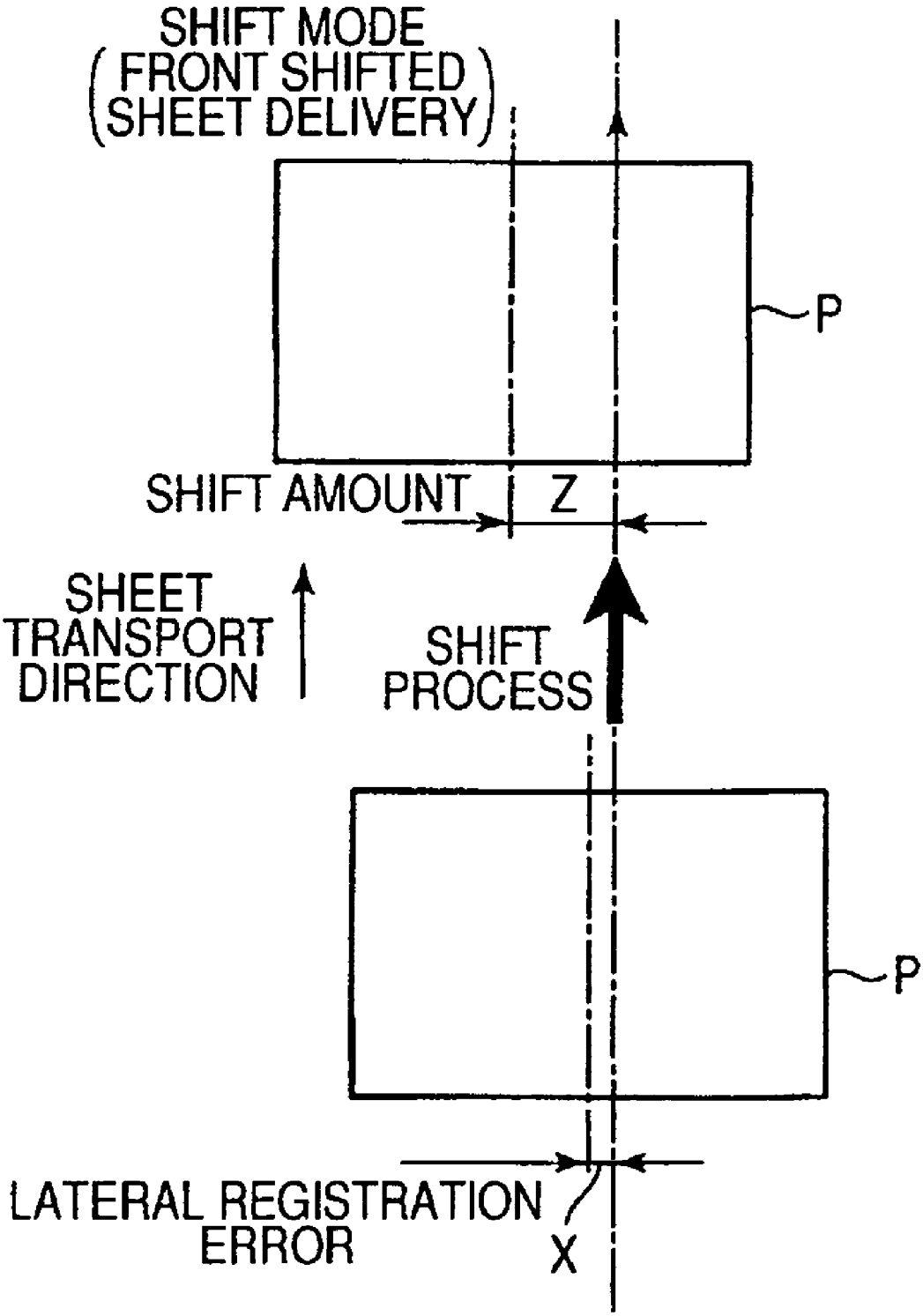
FIG. 6 is a view illustrating a sheet shift operation of the sheet process apparatus.

Next, the sheet transported by the pair of inlet rollers 102 is detected for the end position by the lateral registration sensor 104, while passing through a transport path 103, whereby the degree to which the sheet is shifted in the lateral direction with respect to the center position of the sheet process apparatus 100 is detected. A lateral registration error amount corresponding to the shift in the lateral direction is defined as X as shown in FIG. 6 described later.

Next, after the lateral registration error is detected, the sheet is transported to the first pair of buffer rollers 115 by the pairs of shift rollers 206 and 207 of the shift unit 108, and a pair of transport rollers 110A composed of a transport roller 110 and a separation roller 111. The shift unit 108 will be described later in detail.

Then, in the case where the sheet transported to the first pair of buffer rollers 115 is delivered to an upper tray 136, an upper path switching flapper 118 is switched by a solenoid (not shown) or the like, whereby the sheet is guided to an upper path transport path 117. After that, the sheet is delivered to the upper tray 136 by an upper discharge roller 120.

In the case where the sheet is not delivered to the upper tray 136, the sheet is buffered by the buffering portion 999. That is, the sheet transported to the first pair of buffer rollers 115 is guided to a path 191 by the switching of the upper path switching flapper 118, and then, guided to the buffer path 193 by the buffering flapper 192. Further, the sheet guided to the buffer path 193 is transported by the second pair of buffer rollers 194 and the third pair of buffer rollers 112 provided in the buffer path 193.

Herein, the sheet transported by the second pair of buffer rollers 194 and the third pair of buffer rollers 112 is transported with the following second sheet transported by the pair of transport rollers 110A. At this time, the sheets are transported with the respective ends thereof aligned. That is, two sheets are transported under the condition that they are overlapped.

The overlapped two sheets are transported by the first pair of buffer rollers 115, and guided to the path 191 again by the upper path switching flapper 118. After that, the sheets are guided to the buffer path 193 by the buffering flapper 192. Then, the sheets are transported by the second pair of buffer rollers 194 and the third pair of buffer rollers 112. After that, the overlapped two sheets are transported with the ends aligned with the end of the following third sheet transported by the pair of transport rollers 110A.

Then, the overlapped three sheets are transported by the first pair of buffer rollers 115, and guided to the path 191 by the upper path switching flapper 118. After that, the sheets are guided to a stack transport path 195 by the buffering flapper 192 that has been switched to the stack transport path 195 side, and pass through the stack transport path 195 successively by pairs of stack transport rollers 122 and 123.

Herein, in the case of performing a saddle stitching process with respect to the sheets, the saddle path switching flapper 125 is switched to the saddle unit 135 side by the driving means such as the solenoid (not shown), whereby the three sheets are transported to a saddle path 133. After that, the three sheets are guided to the saddle unit 135 by a pair of saddle inlet rollers 134 to be subjected to a saddle stitching process.

On the other hand, in the case where the three transported sheets are delivered to a lower tray 137, the sheets transported to the pair of stack transport rollers 123 are transported to the lower path 126 by the saddle switching flapper 125 that has been switched to the lower path 126 side.

Figure 3:
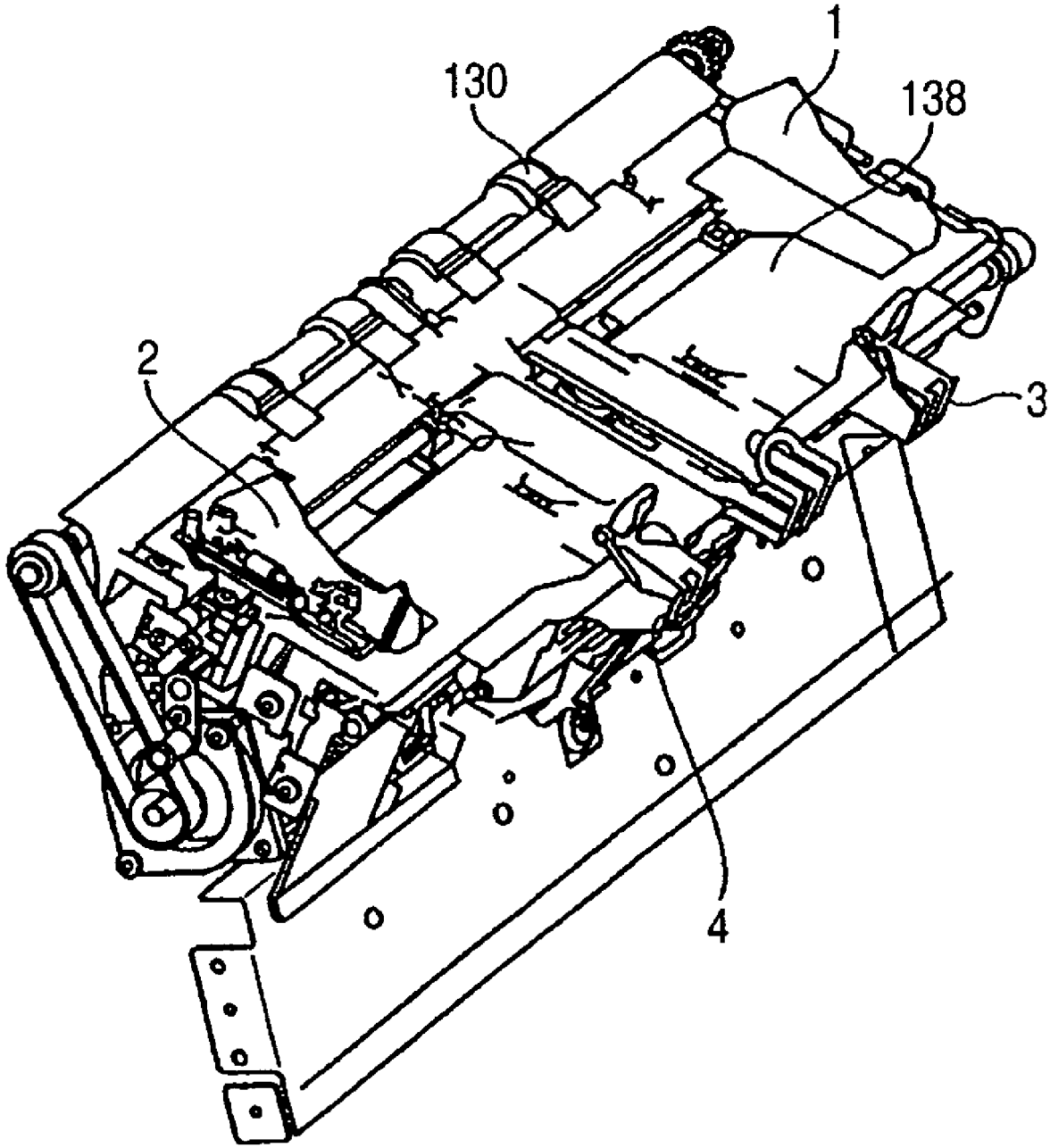
FIG. 3 is a perspective view of a process tray back portion of the sheet process apparatus.

After that, the sheets are delivered to the process tray 138 serving as a sheet process tray by a pair of lower discharge rollers 128, and the transport direction is first aligned by the return means such as a paddle 131 and a knurl belt 129, and trailing end regulating members 3 and 4 serving as aligning means for the transport direction shown in FIG. 3.

Next, the sheets are aligned in the lateral direction by aligning plates 1 and 2 that are a pair of aligning members that can move in the lateral direction, and moves in the lateral direction by a driving source (not shown) to perform alignment in the lateral direction of sheets, whereby the sheets are aligned on the process tray 138. After that, the sheets are stitched by the stapler 132 shown in FIG. 2, if required. Then, the sheets are delivered to the lower tray 137 serving as a deliver tray by the pair of stack discharge rollers 130 serving as sheet bundle transport deliver members.

In this embodiment, when a lateral registration error of the sheets is detected by the lateral registration sensor 104 as described above, the shift unit 108 is moved in the lateral direction by a predetermined amount while the sheets are being transported by the pairs of shift rollers 206 and 207. Thus, the sheets are shifted.

Figure 4:
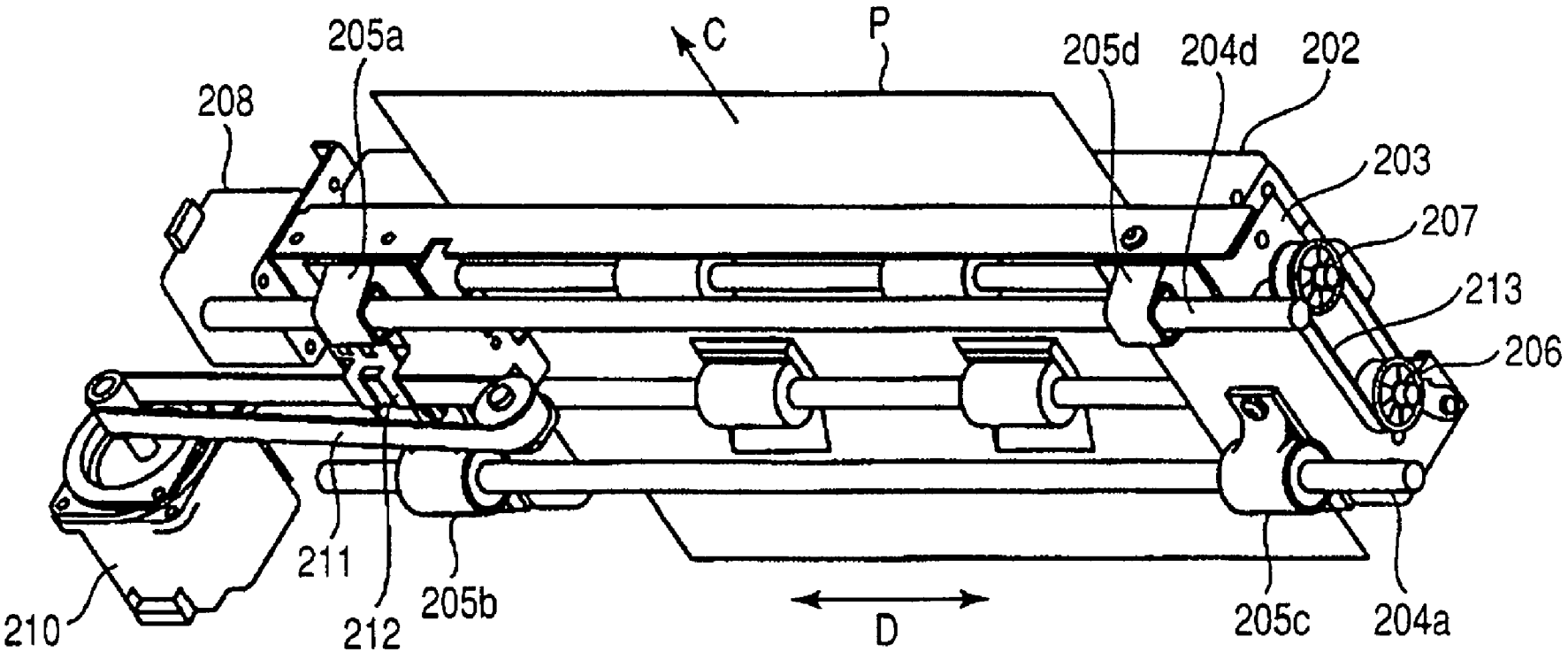
FIG. 4 is a perspective view of a shift unit of the sheet process apparatus.
Figure 5:
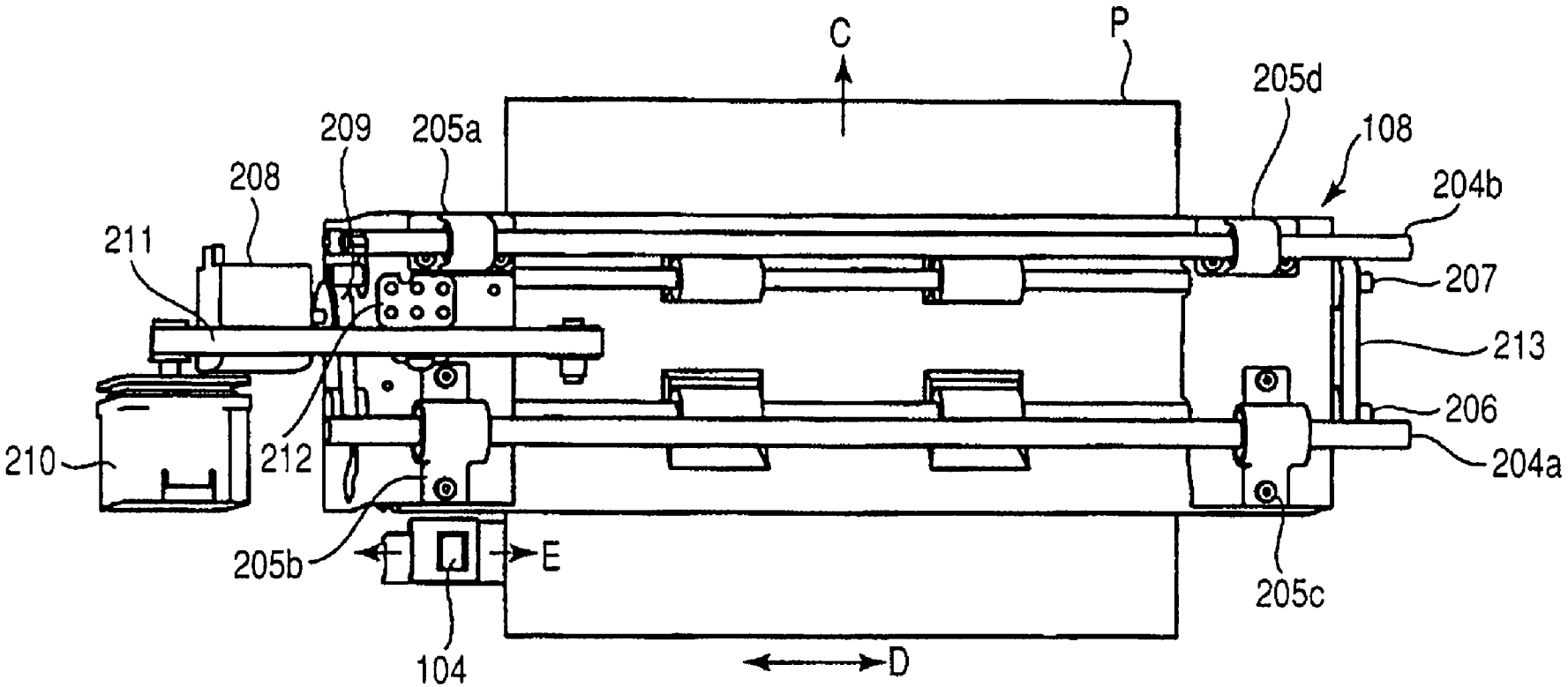
FIG. 5 is a bottom view of the shift unit of the sheet process apparatus.

FIGS. 3 and 4 show a configuration of the shift unit 108. The shift unit 108 includes the pairs of shift rollers 206 and 207, and is held slidably by slide rails 204*a* and 204*b* fixed to the sheet process apparatus 100 via slide bushes 205*a*, 205*b*, 205*c*, and 205*d*.

Reference numeral 210 denotes a shift motor for sliding the shift unit 108. When the shift motor 210 is driven, a fixing member 212 fixed to the shift unit 108 via a driving belt 211 moves in the lateral direction. Further, the shift unit 108 moves in the lateral direction in accordance with the movement of the fixing member 212. Then, this operation is performed while the sheets are sandwiched between the pairs of shift rollers 206 and 207, the sheets P can be shifted in the D direction that is the lateral direction by a predetermined amount while being transported.

In the shift unit 108 with such the configuration, the pair of shift rollers 207 are rotated by the driving of a shift transport motor 208 transmitted via the driving belt 209. Further, the pair of shift rollers 206 are rotated by the rotation of the pair of shift rollers 207 transmitted via the driving belt 213. The sheets P transported from the apparatus body 300 are transported in the C direction that is the sheet transport direction by the pairs of shift rollers 206 and 207 that are rotated by the driving of the shift transport motor 208.

At this time the lateral registration sensor 104 moves in an arrow E direction by the driving means (not shown), whereby the position (herein, lateral registration error X) of the sheets is detected. In this embodiment, the shift motor 210 is driven, and, as shown in FIG. 6, the shift unit 108 is moved by a shift amount Z of the sheets obtained by adding the lateral registration error X to a predetermined shift amount of the shifts, whereby the sheets P are shifted during transportation. The shift amount Z will be described later. Further, the shift motor 210 is driven with a signal from a CPU 50 described later.

Herein, in this embodiment, the shift unit 108 includes two pairs of shift rollers 206 and 207, so the sheets P can be gripped reliably. Therefore, for example, in the case of a sheet with a long size such as an A3 size, even when the leading end or the trailing end of the sheets P subjected to resistance during the path, they can easily overcome the moment generated by the sliding resistance.

Consequently, a so-called skew and the like of the sheets P, generated by the occurrence of sliding of the pairs of shift rollers 206 and 207 during the shift, do not occur. This makes it possible to transport the sheets P while allowing those sheets to shift stably. In this embodiment, two pairs of shift rollers 206 and 207 are used. However, three or more pairs of shift rollers may be used. In the case of using the sheets P that are not likely to slide, it is possible to use one shift roller.

Further, when the shift unit 108 moves, the leading end may reach the pair of transport rollers 110A depending upon the size of the sheet. In this case, the separation roller 111 is separated from the transport roller 110. Because of this, the shift of the sheets P is not prevented by the pair of transport rollers 110A.

The separation roller 111 is biased to the transport roller 110 side by a compression spring (not shown), and the movement thereof is guided by a guide member (not shown). Further, the separation roller 111 is configured so as to move in the contact/separation direction by roller position detecting means (not shown) and driving means (not shown).

Figure 7:
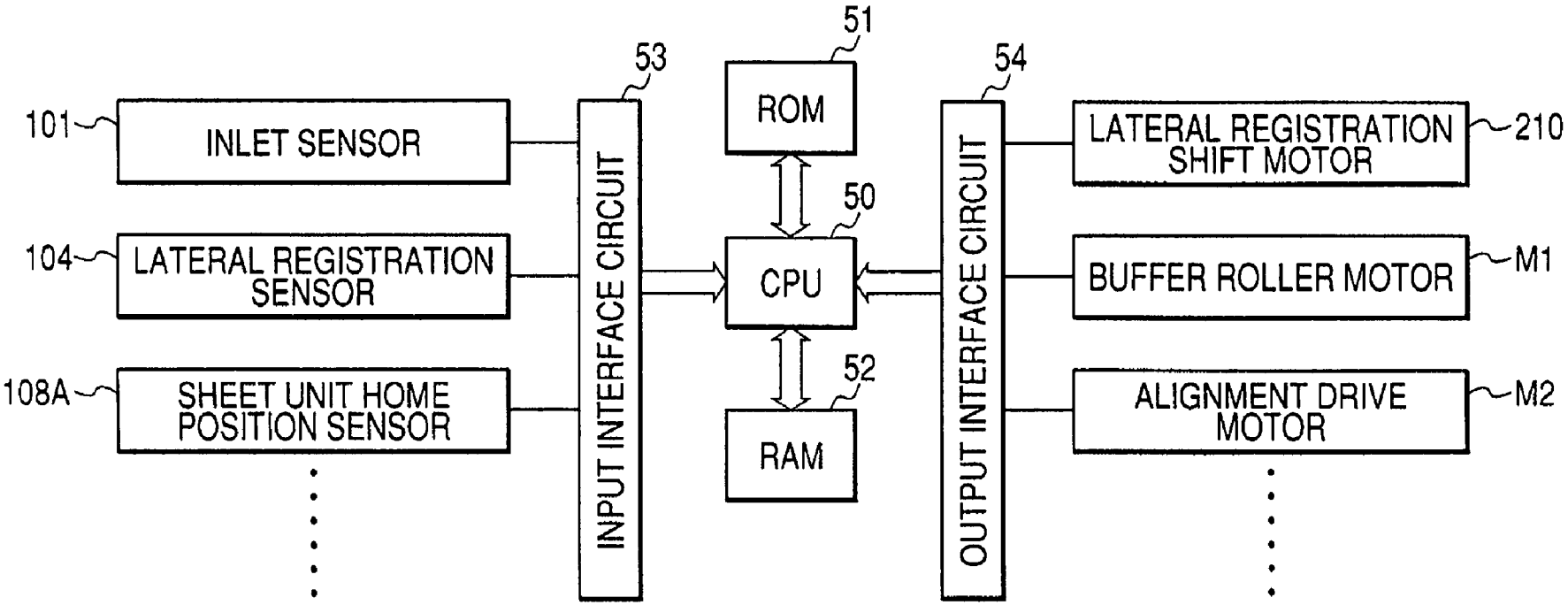
FIG. 7 is a control block diagram of the sheet process apparatus.

FIG. 7 is a control block diagram of the sheet process apparatus 100 according to this embodiment. In FIG. 7, reference numeral 50 denotes a CPU, 51 denotes a ROM, and 52 denotes a RAM. In the ROM 51, a program for a puncher process and a program for a stapling process are previously stored. The CPU 50 that is a control portion executes each program, and performs an input data process while exchanging data appropriately with the RAM 52, thereby creating a predetermined control signal.

Each signal from the inlet sensor 101, a shift unit home position sensor 108A, the lateral registration sensor 104, and the like is incorporated in the CPU 50 as input data via an input interface circuit 53. The shift unit home position sensor 108A detects a home position of the shift unit 108.

Further, each control signal from the CPU 50 is sent to a driving motor M1 for driving the lateral registration motor 210, and first to third pairs of buffer rollers 115, 194, and 112 via an output interface circuit 54 and a motor driver (not shown). Further, each control signal from the CPU 50 is also sent to a driving motor M2 and the like of the aligning members 1 and 2, thereby controlling each motor appropriately.

Herein, in this embodiment, data communication is performed between the control device 950 and the CPU 50 provided on the copying machine body 300 side. Through the data communication, various pieces of information such as the original size, the number of original copies by ADF, and the like are incorporated in the CPU 50. The function of the CPU 50 may be performed by the control device 950 on the copying machine body 300 side. That is, the control device 950 provided in the copying machine body 300 may control each motor of a finisher.

In the case of performing a staple process and a saddle stitching process, it is known that a predetermined period of time is usually required. Although partly depending upon the image forming speed on the copying machine body 300 side, this time interval is generally longer than a general sheet interval.

Therefore, the sheet process is performed without stopping the image forming operation on the copying machine body 300 side, so a so-called sheet buffer process described above is performed. That is, buffering is performed by the buffering portion 999 under the condition that a process of a previous stack is performed in the process tray 138 by the first to third pairs of buffer rollers 115, 194, and 112, and the buffer path 193, etc.

Figure 8A:
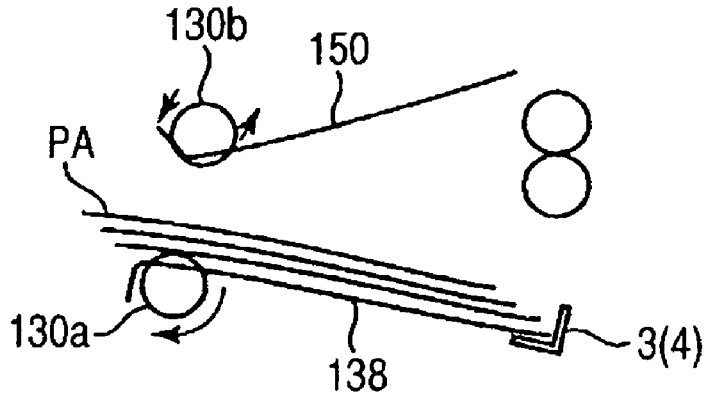
FIGS. 8A and 8B are views illustrating an operation of the sheet process apparatus.
Figure 8B:
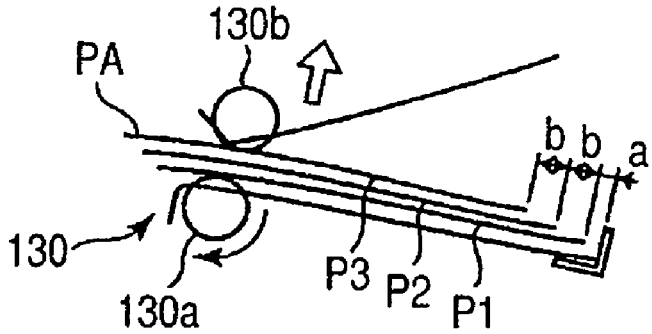

Then, as described above, a plurality of (e.g., three) sheets are overlapped by the buffering, and the three sheets of the first stack thus overlapped are all delivered to the process tray 138, and then aligned. After that, a swinging guide 150 that has ascended as shown in FIG. 8A descends as shown in FIG. 8B.

Because of this, an upper roller 130*b* constituting the pairs of stack discharge rollers 130 are placed on a sheet bundle PA, and the stapler 132 staples the sheet bundle. The stapled sheet bundle PA is delivered to a stack tray 137 shown in FIG. 2.

On the other hand, during such a staple operation, the following sheets delivered from the apparatus body 300 are buffered by the buffering portion 999. When the staple operation is completed, the three sheets of the subsequent second stack overlapped by the buffering portion 999 are transported toward the process tray 138.

Figure 9A:
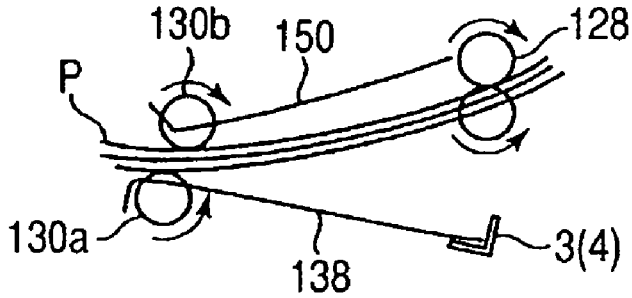
FIGS. 9A and 9B are views illustrating an operation of the sheet process apparatus.
Figure 9B:
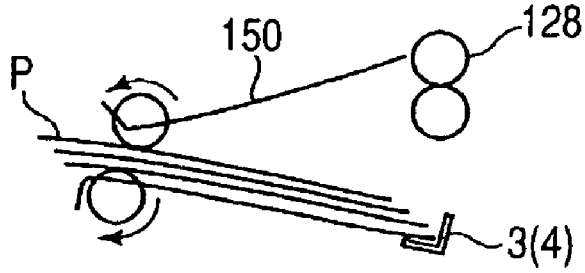

At this time, the swinging guide 150 remains descended, whereby the pair of stack discharge rollers 130 receive the second sheet bundle PA of overlapped three sheets as shown in FIG. 9A. When the trailing end of the sheet bundle PA comes out of the pair of lower discharge rollers 128, the pair of stack discharge rollers 130 are reversed as shown in FIG. 9B, and the swinging guide 150 ascends before the trailing end abuts on the trailing end regulating members 3 and 4.

Consequently, the roller 130*b* leaves the sheet surface. After the roller 130*b* leaves the sheet surface, the trailing end of the sheet bundle PA is aligned with the sheet bundle PA abutting on the trailing end regulating members 3 and 4. After that, the side ends of the sheet bundle PA are aligned by the aligning plates. Regarding the third and the subsequent stacks, the same operation as that of the second stack is performed, and a set number of sheets are stacked on a stack tray 137, whereby the operation is completed.

In the sheet process apparatus 100, the transport direction length (distance from the trailing end regulating members 3 and 4 to the pair of stack discharge rollers 130) of the process tray 138 is 200 mm or less. Therefore, in particular, regarding the large size such as A3 and LDR, the sheet trailing end (upstream side in the transport direction) is stacked on the process tray 138, and the leading end is stacked on the stack tray 137 (or on the sheets that have already been stacked).

As shown in FIG. 3 described above, the aligning plates 1 and 2 that are aligning members are provided on the process tray 138, and are positioned and sized so as to align the trailing end side from the center of gravity with respect to the sheet of the above-mentioned large size. This configuration is effective for saving space in the entire apparatus. However, the present invention is not limited thereto.

Figure 10A:
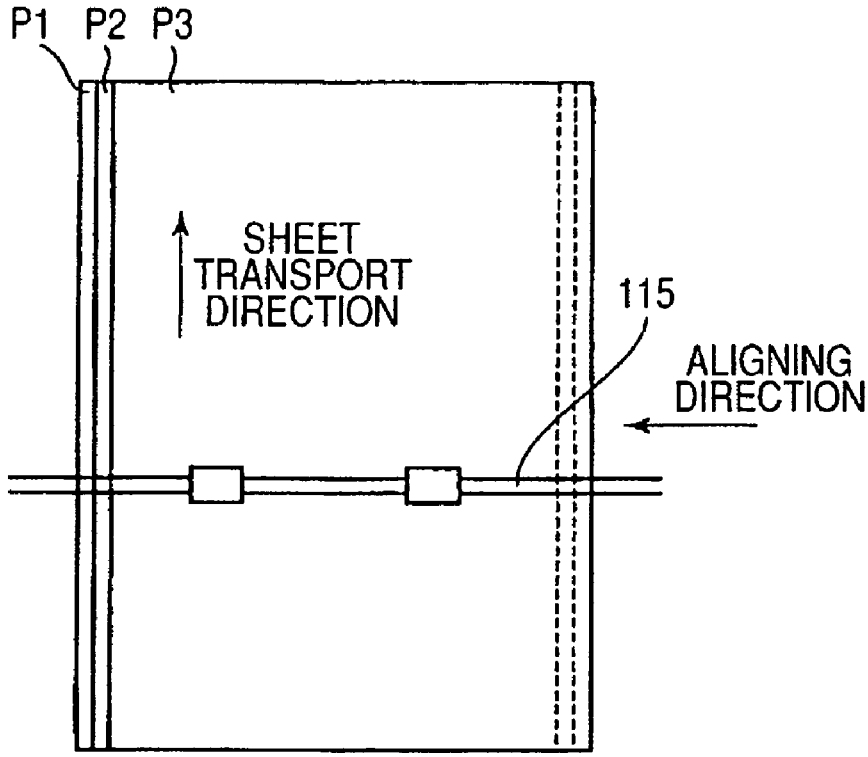
FIGS. 10A and 10B are views illustrating a sheet alignment operation of the sheet process apparatus.
Figure 10B:
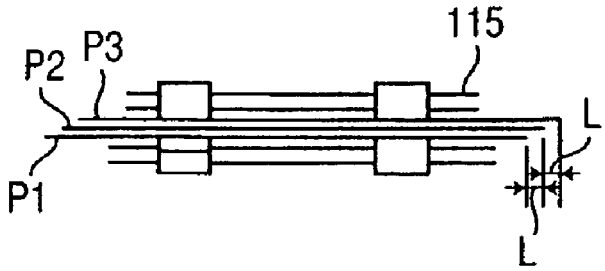

In this embodiment, when a buffer process is performed, as shown in FIGS. 10A and 10B, three sheets P1 to P3 are overlapped under the condition of being offset successively by a predetermined amount L in the lateral direction, i.e., in the alignment direction by the aligning plates. That is, the shift unit 108 shifts the preceding sheets in the same direction as that in the lateral direction for each sheet to be transported. Therefore, the sheets overlapped by the buffering portion 999 are offset in the lateral direction by the shift operation of the shift unit 108. The sheets overlapped by the buffering portion 999 are stacked on the process tray 138 later. Thus, the sheet bundle received on the process tray 138 is stacked under the condition of being offset.

The offset has the following configuration: the sheets P1, P2, and P3 are placed in this order from the bottom under the condition that the sheets are stacked on the process tray 138.

Figures 11A, 11B, 11C:
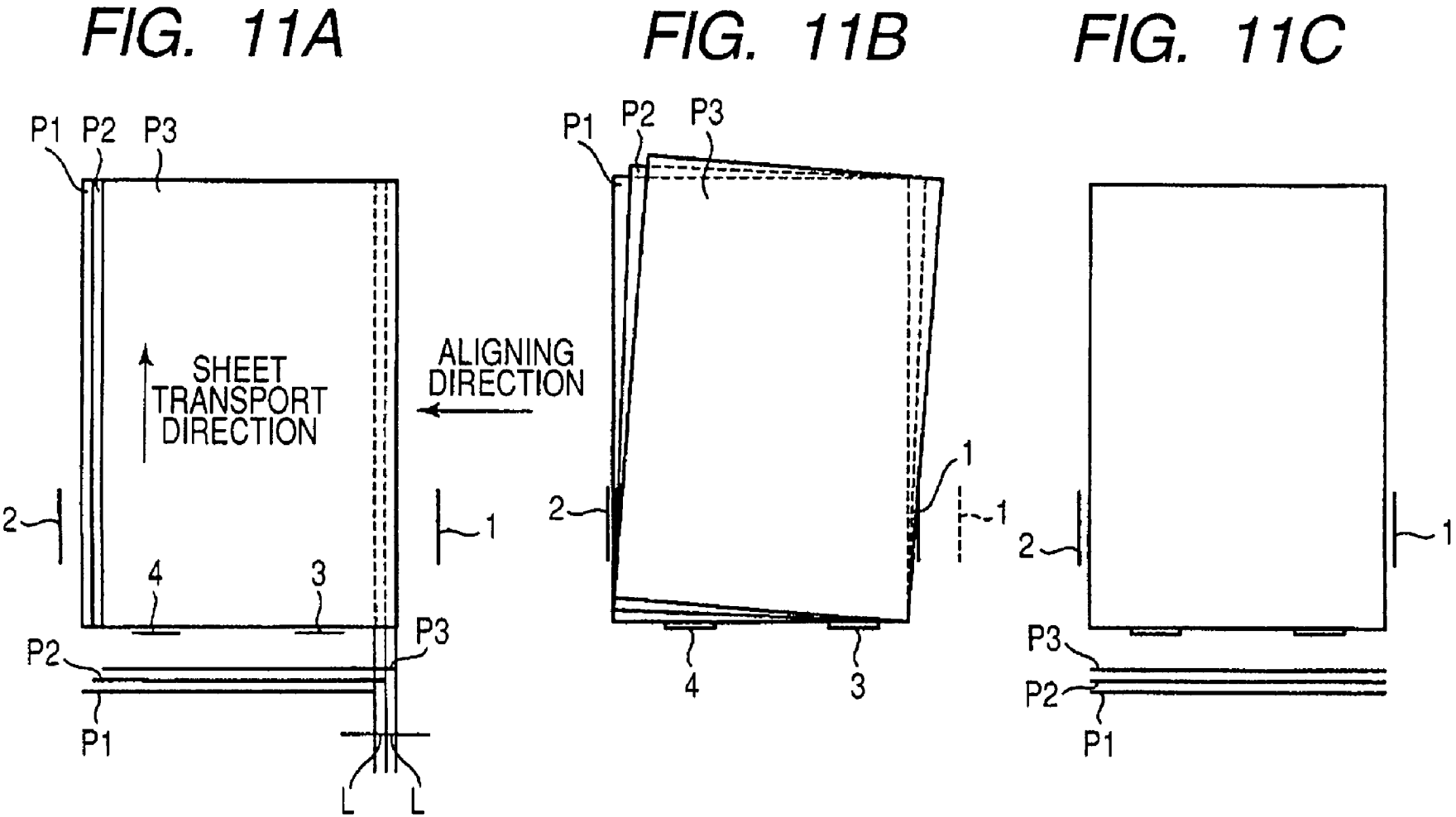
FIGS. 11A, 11B, and 11C are views illustrating a sheet alignment operation of the sheet process apparatus.

That is, the sheets are offset successively with a distance of a predetermined amount L with respect to the aligning plate 2 on the reference side shown in FIG. 11A, and the uppermost sheet P3 is placed so as to be closest to the aligning plate 1 that moves for alignment. Consequently, the third sheet P3 on the top is aligned and moved by the largest amount.

Herein, the offset amount L between the sheets P1 and P2 and the offset amount between the sheets P2 and P3 are not necessarily the same, and it is important that the middle sheet P2 does not protrude compared with the sheet P3 in the direction of the aligning plate 1.

Next, the offset operation during overlapping will be described.

Assuming that the sheets are being transported under the condition that the position of the side end of the first sheet P1 delivered from the apparatus body 300 is shifted by X with respect to the center position of the sheet process apparatus 100 shown in FIG. 6 described above, the lateral registration error X is detected by the lateral registration sensor 104 that is a position detection sensor. A movement amount Z1 of the shift unit 108 is derived from the detected lateral registration error X and the following expression (1), and the shift unit 108 is moved by the movement amount Z1, whereby the sheet P1 moves in the lateral direction.

$$Z1=X+L1 \quad (1)$$

where L1 is an arbitrary value with respect to the center of the process tray, and is variable depending upon the sheet size and the mode.

Next, the second sheet P2 delivered from the apparatus body 300 is transported similarly under the condition of being shifted by X with respect to the center position of the sheet process apparatus 100. Then, the lateral registration sensor 104 detects the lateral registration error X, and a movement amount Z2 of the shift unit 108 is derived from the following expression (2).

$$Z2=X+L1+L \quad (2)$$

After that, the shift unit 108 is moved by the movement amount Z2, i.e., by an amount larger than in the case of the first sheet P1 by an offset amount L, whereby the second sheet P2 moves to a position moved by the offset amount L with respect to the first sheet P1. The offset amount L of the sheets P is determined by the process ability and size of the sheet process apparatus 100. In this embodiment, the offset amount L is set to be about 2 to 10 mm.

In a similar manner, the third sheet P3 delivered from the apparatus body 300 is transported similarly under the condition of being shifted by X with respect to the center position of the sheet process apparatus 100. The lateral registration sensor 104 detects the lateral registration error X, and a movement amount Z3 of the shift unit 108 is derived by the following expression (3). After that, the shift unit 108 is moved by the movement amount Z3, whereby the sheet P3 moves to a position moved by the offset amount L with respect to the sheet P2.

$$Z3=X+L1+L+L \quad (3)$$

Thus, by transporting the respective sheets P1, P2, and P3 to the buffering portion 999 while offsetting the sheets successively by a predetermined amount L, the sheet bundle has a form as shown in FIG. 11A.

Further, during the shift operation, in the case where a sheet size is small (herein, this refers to a sheet with a transport direction length of LTR (216 mm) or less), a shift process is completed before the sheet leading end reaches the pair of transport rollers 110A. In this case, the separation roller 111 receives the sheets while being pressed against the transport roller 110.

Further, when the sheet size is large (the transport direction length is LTR (216 mm) or more), the leading end may reach the pair of transport rollers 110A. In this case, the separation roller 111 is separated from the transport roller 110. Because of this, the shift of the sheets P is not prevented by the pair of transport rollers 110A. After the shift unit 108 performs a shift operation, the separation roller 111 is pressed against the transport roller 110, and transports the sheets while sandwiching them.

Next, the operation of aligning the sheet bundle received on the process tray 138 under the condition that the sheets are offset successively by a predetermined amount L will be described with reference to FIGS. 11A, 11B and 11C.

FIG. 11A shows a state where the sheets P1 to P3 of the sheet bundle PA stacked under the condition of being offset are returned to the trailing end regulating members 3 and 4 on the process tray 138. FIG. 11B shows a state where the sheets P1 to P3 are aligned by the aligning plate 1. FIG. 11C shows a state where the alignment in the transport direction is performed by the self-weight or return means after the sheets are aligned by the aligning plate 1.

Herein, as is apparent from FIG. 11B, when the alignment operation is performed by the aligning plate 1, one end portion of the respective sheets P1 to P3 tilts as shown. In particular, in the case of aligning the sheets of a large size, the aligning plate 1 is positioned behind the center of gravity of the sheets, so the aligning plate 1 is likely to tilt. At this time, the alignment amount of the third sheet P3 on the top is largest, so the tilt amount thereof is also large. That is, the tilt amount of the three sheets P1 to P3 has a relationship: P1<P2<P3.

Owing to the tilt of the sheets P1 to P3, when the sheet bundle PA is returned in the direction of the trailing end regulating member by the self-weight or the return means after the alignment, the respective sheets can return in the direction of the trailing end regulating member successively from the lowest sheet P1 as shown in FIG. 11C. That is, the second sheet P2 can return in the direction of the trailing end regulating members 3 and 4 without being skipped by the first sheet P1, and accompanying the upper sheet P1.

Consequently, the alignment defect can be prevented, in which the first sheet P1 is returned first, and the second sheet P2 cannot be returned due to the resistance of the sheet P1. At this time, the aligning plate 1 may be retracted slightly to enhance the sheet return property.

Further, the friction coefficient between the process tray 138 and the sheet P is smaller than the friction coefficient between the sheets, and the sheet stacking surface of the process tray 138 is made smooth. This can prevent that, when the sheet bundle PA abuts on the trailing end regulating members 3 and 4, the lowest first sheet P1 cannot return due to the resistance, whereby the tilt correction of the sheet bundle PA can be reliably performed.

Thus, provided is the shift unit 108 serving as shift transport means for shifting the sheets to a sheet transport direction upstream side of the process tray 138 serving as sheet stacking means, and transporting the sheets while increasing the shift amount successively for each sheet to be transported. Then, the sheets transported with the shift amount being increased successively by the shift unit 108 are stacked on the process tray 138. By aligning the stacked sheets under the condition of being successively shifted with the trailing end regulating members 3 and 4 and the aligning plates 1 and 2 that are aligning means, the alignment of the sheets can be enhanced.

Further, with such a configuration, in particular, the alignment of a large size can be enhanced, and the alignment can be enhanced with straddling stacking without increasing the size of the aligning plates 1 and 2. Consequently, the productivity is enhanced, and the space can be saved.

In this embodiment, three sheets have been illustrated as the sheet bundle PA. However, this embodiment is also effective when two or four or more sheets are used as the sheet bundle PA.

In the above description, the shift unit 108 is provided to offset the sheets. However, the buffering portion 999 may be configured so as to be movable in the lateral direction (axis direction), and the buffering portion 999 may be moved in the lateral direction by a predetermined amount successively in the order of overlapping the sheets. That is, the buffering portion 999 serving as transport means for transporting the sheets being kept overlapped one on another may be used as shift transport means. In this case, the shift unit 108 is not required.

In the above description, as shown in FIG. 2, the shift unit 108 is provided on an upstream side of the buffering portion 999. However, the upper tray 136, the lower tray 137, the saddle unit 135, and the like may be provided on an upstream side. Thus, when the sheets are delivered to each unit, they can be delivered at a position shifted by a predetermined amount or at a center position of the sheet process apparatus 100.

Further, the aligning plate 2 on the reference side is not required to be fixed. The aligning plate 2 may be aligned and moved to the vicinity of the end of the sheet P1 after the return operation of the sheet bundle PA by the paddle 131, the knurl belt 129, and the like is completed. At this time, if the operation starting timing of the aligning plate 1 is delayed by a predetermined time with respect to that of the aligning plate 2, the alignment of the offset sheet bundle PA can be enhanced.

Figure 12:
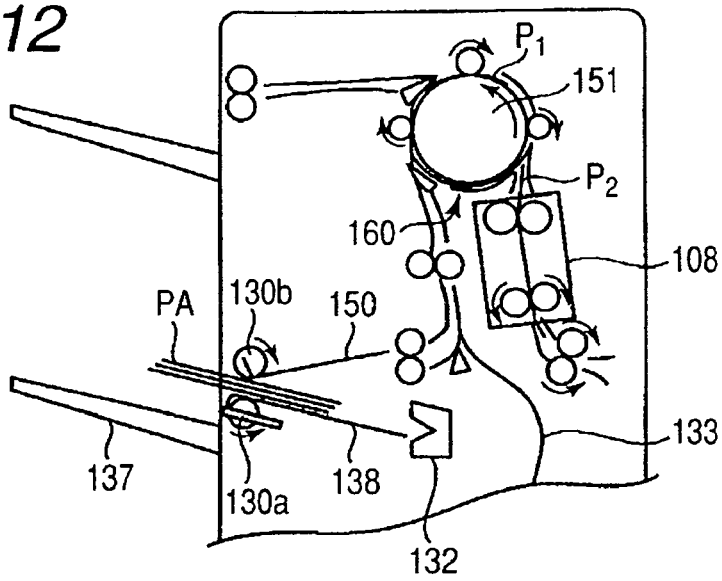
FIG. 12 is a view showing another configuration of a buffering portion provided in the sheet process apparatus.
Figure 13:
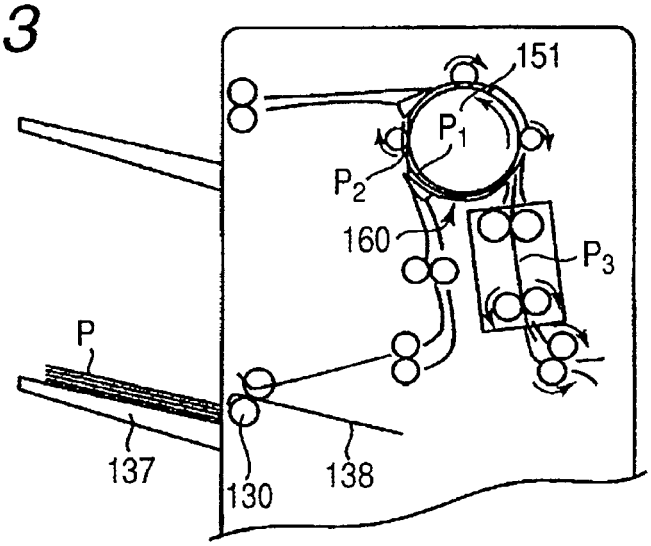
FIG. 13 is a view illustrating a buffering operation of the buffering portion.
Figure 14:
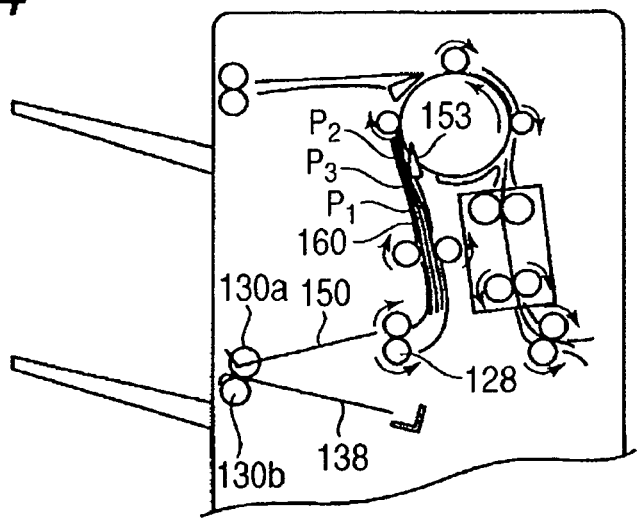
FIG. 14 is a view illustrating a buffering operation of the buffering portion.

Further, in the above description, the case where the pairs of buffer rollers 115, 194, and 112 are provided as the buffering portion 999 has been described. However, a buffer roller 151 may be provided as shown in FIGS. 12, 13 and 14. A sheet may be buffered by winding the sheet around the buffer roller 151.

In the case of using the buffer roller 151 as described above, as shown in FIG. 12, the first sheet P1 is wound around the buffer roller 151 first, and the buffer roller 151 is stopped at a position where the buffer roller 151 proceeds by a predetermined distance.

When the subsequent sheet P2 is delivered from the apparatus body 300, the buffer roller 151 rotates at a predetermined timing, winds the first sheet P1 and the second sheet P2 around the buffer roller 151 as shown in FIG. 13, and stops at a predetermined distance. After that, when the third sheet P3 is delivered, the buffer roller 151 rotates at a predetermined timing, and allows the sheet P3 to be overlapped as shown in FIG. 14. Then, the buffer roller 151 transports the three sheets P1 to P3 to the process tray 138. Accordingly, the three sheets P1, P2, and P3 can be transported to the process tray 138 under the condition of being offset.

Next, second Embodiment of the present invention will be described.

Figure 15A:
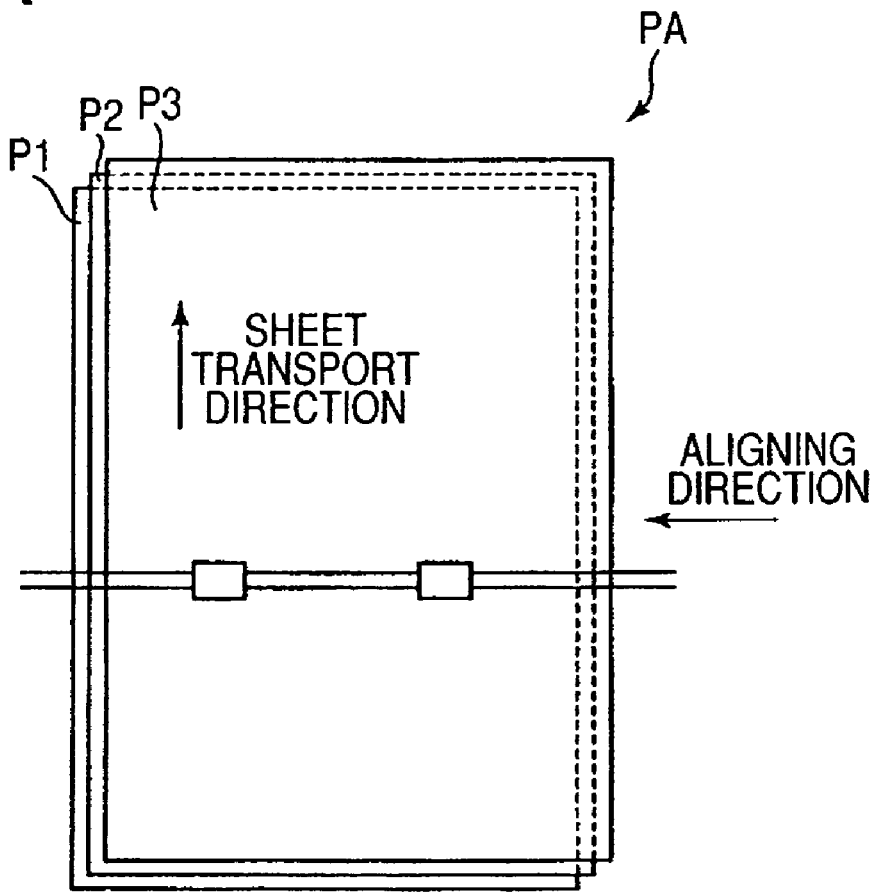
FIGS. 15A and 15B are views illustrating a sheet alignment operation of a sheet process apparatus according to second Embodiment of the present invention.
Figure 15B:
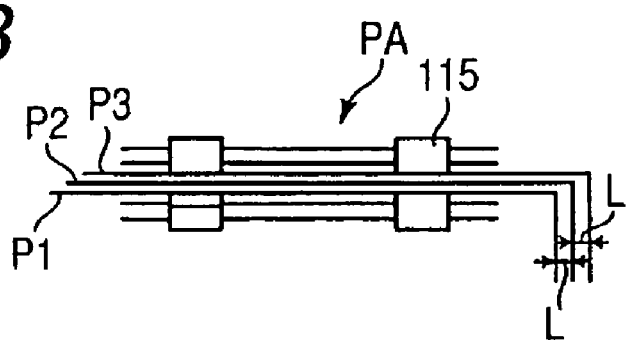

FIGS. 15A and 15B are views illustrating the sheet alignment operation of the sheet processing apparatus according to this embodiment. In FIGS. 15A and 15B, the same reference numerals as those in FIGS. 10A and 10B denote the same or corresponding components.

Herein, in this embodiment, when the sheets are stacked by the buffering portion 999, as well as being offset in the lateral direction, the sheets are stacked under the condition of being offset in the sheet transport direction.

That is, in this embodiment, the shift transport device is composed of the shift unit 108 that is a shift transport unit for transporting the sheets while shifting them in the lateral direction and increasing the shift amount successively, and the buffering portion 999 that is transport means.

In this embodiment, in the buffering portion 999, as shown in FIGS. 15A and 15B, the second sheet P2 is offset to a downstream side with respect to the first sheet P1, and the third sheet P3 is offset to a downstream side with respect to the second sheet P2.

Herein, the offset amount in the transport direction of the sheets P and the ascending timing of the swinging guide are related to the stabilization period of the sheets depending upon the return speed of the stack discharge roller, i.e., determined by the process ability of the sheet process apparatus 100. In this embodiment, with the sheet transport speed of 750 mm/s, the offset amount (about 20 mm), and the stack discharge roller return speed of 500 mm/s, the separation position of the stack discharge roller is set to be a timing at which the sheet P1 reaches a position that is about 40 mm or less before abutting on the stopper.

The sheet bundle PA is stacked under the condition of being offset in the sheet transport direction, as well as being offset in the lateral direction, so a lower sheet is not skipped by an upper sheet. Therefore, the sheets can abut on the trailing end regulating member in the order from the bottom.

Thus, a plurality of sheets to be transported with the shift amount increased in the lateral direction by the shift unit 108 are transported while being stacked by the buffering portion 999, whereby the alignment in the transport direction as well as the alignment in the lateral direction can be enhanced.

Next, third Embodiment of the present invention will be described.

Figures 16A, 16B, 16C:
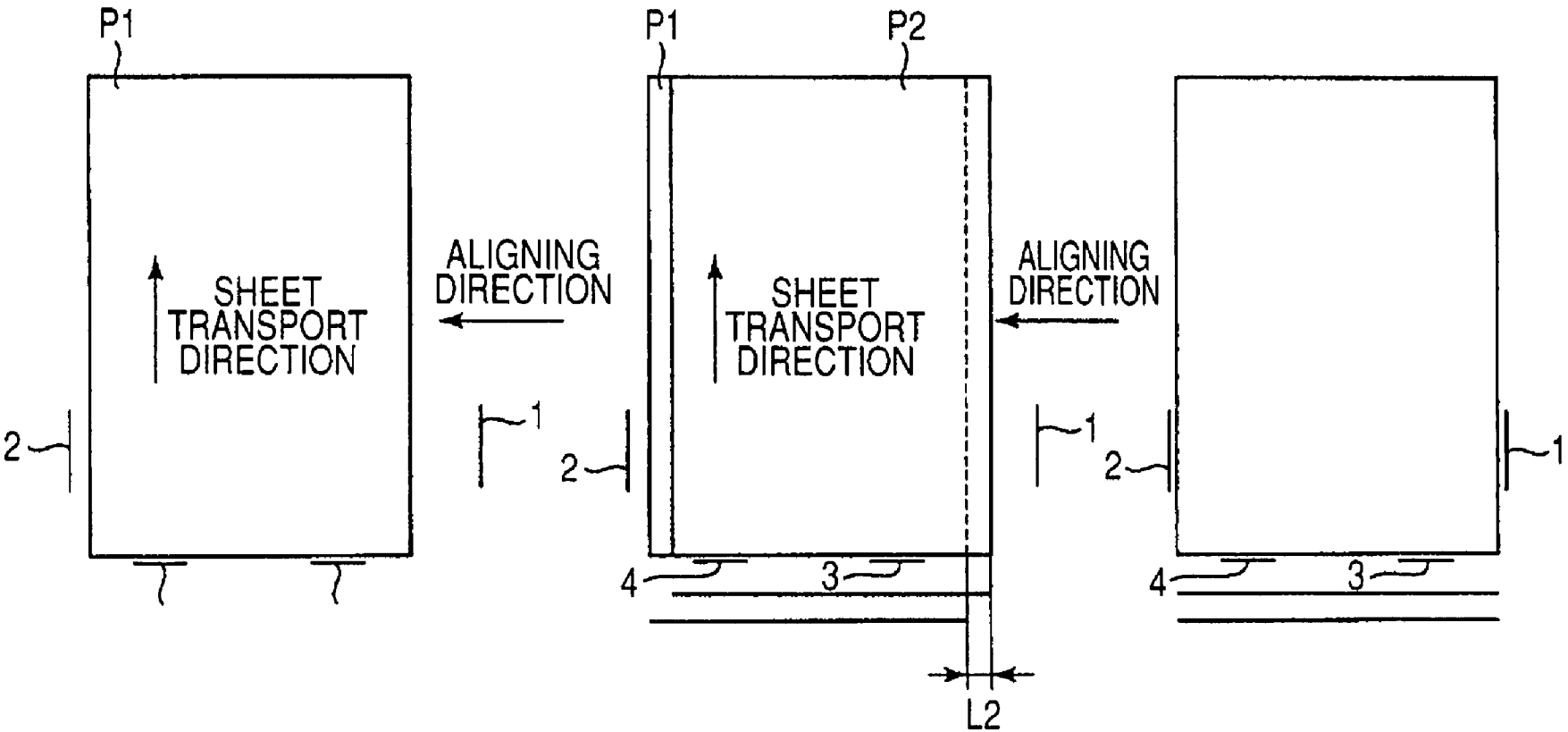
FIGS. 16A, 16B, and 16C are views illustrating a sheet alignment operation of a sheet process apparatus according to third Embodiment of the present invention.
Figure 17:
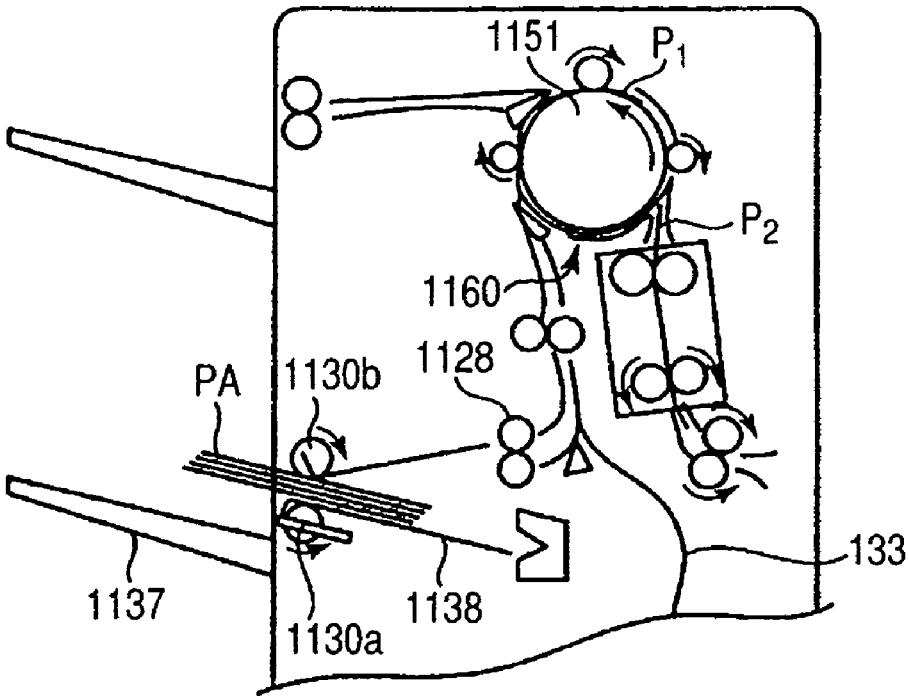
FIG. 17 is a view showing a configuration of a buffering portion provided in a conventional sheet process apparatus.
Figure 18:
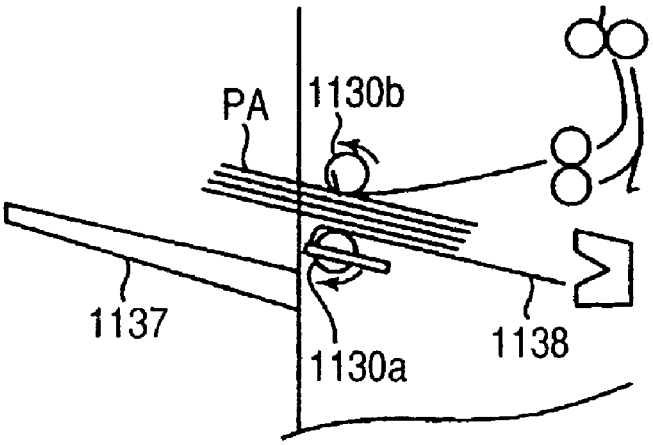
FIG. 18 is a view illustrating a sheet process operation of the conventional sheet process apparatus.
Figure 19A:
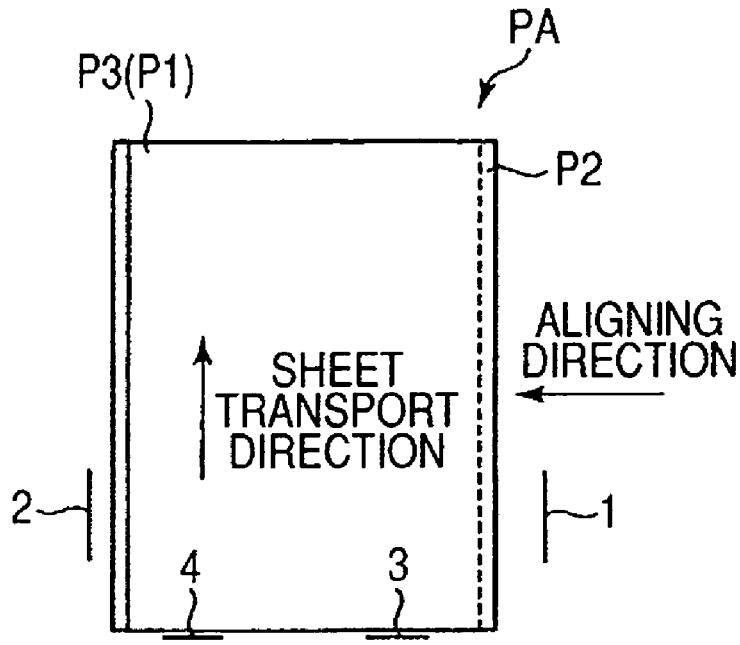
FIGS. 19A, 19B, and 19C are views illustrating a sheet alignment operation of the conventional sheet process apparatus.
Figure 19B:
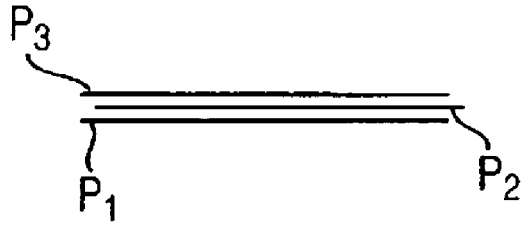
Figure 19C:
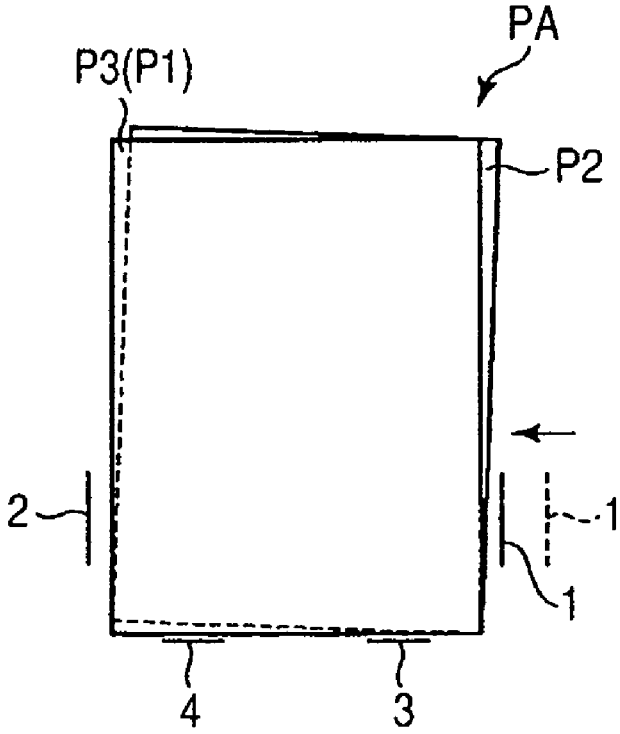
Figures 20A, 20B, 20C:
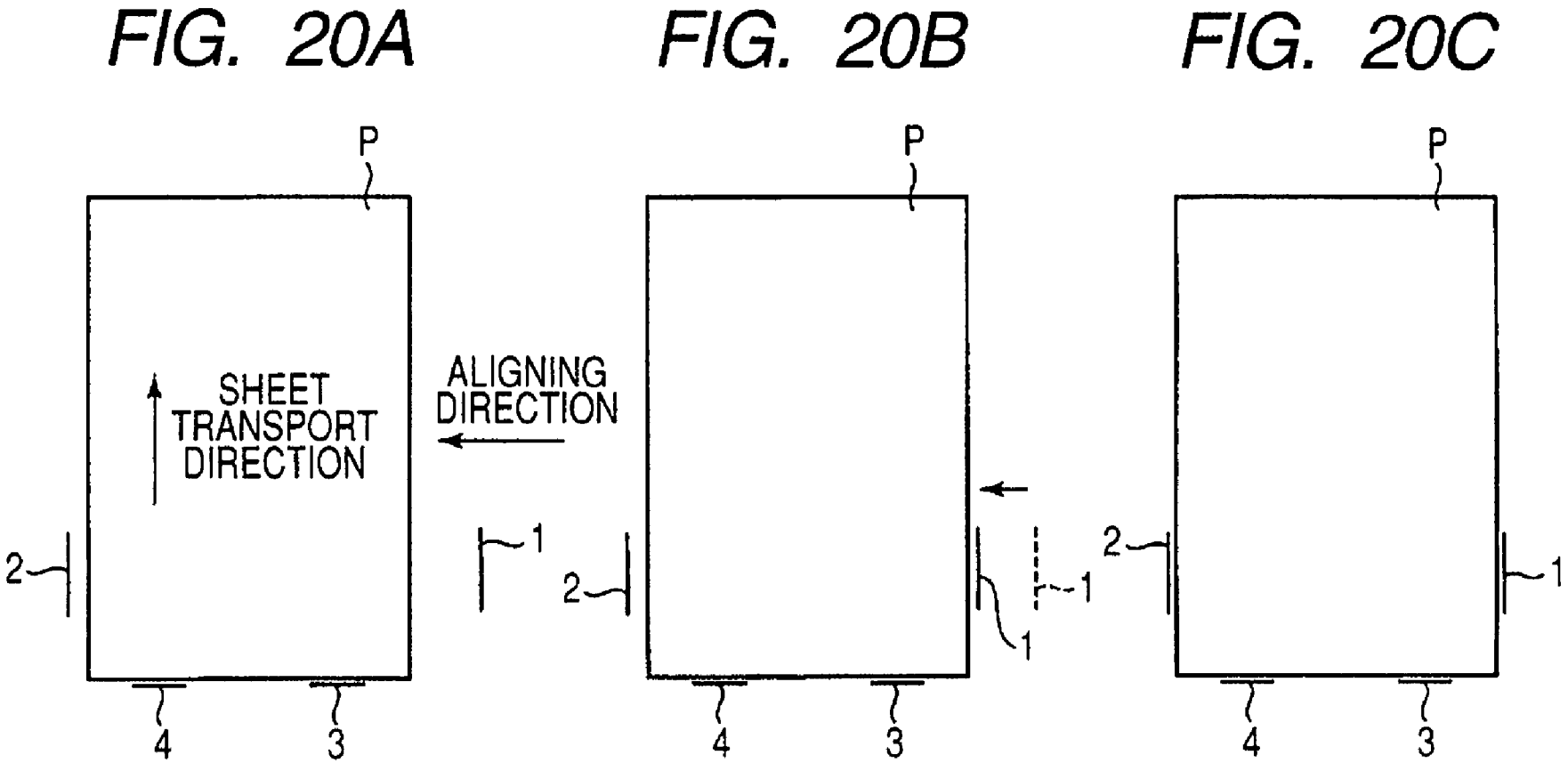
FIGS. 20A, 20B and 20C are views illustrating a sheet alignment operation of the conventional sheet process apparatus.

FIGS. 16A, 16B and 16C are views illustrating the sheet alignment operation of the sheet process apparatus according to this embodiment. In FIGS. 16A and 16B, the same reference numerals as those in FIGS. 10A and 10B denote the same or corresponding components.

As described above, in the case of processing the first sheet P1, the swinging guide 150 is separated, and the stack discharge roller 130 is inverted, so it takes a longer period of time than the process time of the second and subsequent sheets delivered to the process tray 138.

Therefore, when the first sheet is being subjected to an alignment operation by the aligning plate 1, depending upon the timing of sheet feed with respect to the second sheet, the leading end of the second sheet and the aligning plate 1 interfere with each other, which causes inconvenience such as JAM, leading end damage, and decrease in productivity.

In order to prevent this, the alignment operation in the lateral direction by the aligning plates 1 and 2 with respect to the first sheet P1 is omitted to buy a process time. However, when the lower sheet P1 protrudes in the direction of the aligning plate 1 compared with the sheet P2 at this time, the above-mentioned alignment defects are caused.

In order to prevent the defects, in this embodiment, the sheets are delivered on the process tray under the condition that the second sheet P2 is shifted by a predetermined amount L2 in the lateral direction with respect to the first sheet P1, and the aligning plate 1 is operated after the completion of the return operation to the trailing end regulating member so that two sheets are aligned simultaneously. This can enhance the alignment.

Herein, the sheet P1 is one sheet. However, as in first and second Embodiments described above, the sheet P1 may be a sheet bundle of a plurality of sheets offset by a predetermined amount and buffered.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-264779, filed Sep. 13, 2005, which is hereby incorporated by reference herein in its entirety.

What is claimed is:

1. A sheet process apparatus for aligning sheets stacked on a sheet process tray, comprising:

a shift transport unit which transports a sheet while successively shifting each sheet in a width direction perpendicular to a sheet transport direction; an other transport unit provided between said shift transport unit and the sheet process tray, which stacks and transports a plurality of sheets which are shifted in the width direction and are transported by said shift transport unit; and an aligning member which moves the plurality of sheets, which are transported from said other transport unit to the sheet process tray, toward an alignment direction, thereby performing an alignment in the width direction, wherein said shift transport unit stacks the transported sheets by shifting in the width direction so that upper sheets of the plurality of sheets stacked on the sheet process tray are successively shifted in a direction opposite to the alignment direction of said aligning member with respect to the width direction of a lower sheet, and wherein said aligning member moves the plurality of sheets, which are in a condition that upper sheets are successively shifted with respect to lower sheets on the sheet process tray, toward the alignment direction, thereby shifting the sheets.

2. A sheet process apparatus according to claim 1, wherein said other transport unit transports the plurality of sheets to the sheet process tray after stacking the sheets with shifting in a direction of the sheet transport direction.

3. A sheet process apparatus according to claim 1, further comprising a sheet bundle transport deliver member provided between said other transport unit and the sheet process tray, which receives a sheet bundle obtained by said other transport unit and delivers the sheet bundle to the sheet process tray.

4. A sheet process apparatus according to claim 1, further comprising a position detecting sensor which detects a position of an end parallel to a transport direction of the sheets to be transported, wherein a shift amount for shifting the sheets by said shift transport unit is controlled in accordance with the position of the end of the sheets detected by said position detecting sensor.

* * * * *